US005529096A

United States Patent [19]

Rowe, Jr. et al.

[11] Patent Number: 5,529,096

[45] Date of Patent: Jun. 25, 1996

[54] AIR TANK FILLING SYSTEM

[75] Inventors: David F. Rowe, Jr., Advance, N.C.; R. David Lewis, Auburn, Ga.

[73] Assignee: International Safety Instruments, Inc., Lawrenceville, Ga.

[21] Appl. No.: 353,709

[22] Filed: Dec. 12, 1994

[51] Int. Cl.[6] ..... A62B 7/00

[52] U.S. Cl. ..... 141/21; 141/95; 141/197; 128/202.13; 128/205.22; 137/513.3

[58] Field of Search ..... 141/2–4, 18, 21, 141/46, 47, 95, 96, 197; 128/200.24, 202.13, 204.18, 205.22–205.25; 137/513.3, 513.5, 513.7

[56] References Cited

U.S. PATENT DOCUMENTS

| | | | |
|---|---|---|---|
| 2,603,092 | 7/1952 | Buffenmyer | 137/513.3 X |
| 4,111,342 | 9/1978 | Kirby | 128/200.24 X |
| 4,714,077 | 12/1987 | Lambert | 128/204.18 X |
| 4,838,256 | 6/1989 | Miltz | 128/204.18 X |
| 4,862,931 | 9/1989 | Vella | 128/202.13 X |
| 5,323,773 | 6/1994 | Kobayashi | 128/205.24 |
| 5,396,885 | 3/1995 | Nelson | 128/204.18 |

FOREIGN PATENT DOCUMENTS

| | | | |
|---|---|---|---|
| 0089285 | 9/1983 | European Pat. Off. | 128/204.18 |
| 0580816 | 9/1946 | United Kingdom | 137/513.3 |

*Primary Examiner*—J. Casimer Jacyna
*Attorney, Agent, or Firm*—James B. Middleton

[57] ABSTRACT

A self contained braathing apparatus (SCBA) has a fill valve for filling the air tank while a user is wearing the SCBA. An SCBA conventionally has a pressure gauge or other apparatus on a hose that extends around generally to the front of the user, and this apparatus is provided with a quick disconnect valve as a tank fill valve. Such appratus must include a flow limiting orifice, and the present invention includes a check valve in parallel with the orifice so a substantial air flow can be obtained in one direction while the flow in the opposite direction is limited to the safety-mandated small flow.

2 Claims, 1 Drawing Sheet

AIR TANK FILLING SYSTEM

BACKGROUND OF THE INVENTION

1. Field of the Invention

This invention relates generally to filling systems for high pressure air tanks, and is more particularly concerned with means for filling an air tank for a breathing apparatus without removing the breathing apparatus from the user.

1. Discussion of the Prior Art

In the conventional self contained breathing apparatus (SCBA), the apparatus includes at least one air tank. When the air tank is to be filled, the user must take off the SCBA and remove the tank from the SCBA. The tank is then filled, the tank reconnected to the SCBA, and the user again puts on the SCBA. This process requires a good bit of time and trouble.

When an SCBA is used for pleasure, as in underwater exploration, one might easily tolerate the time required to fill a tank, or to exchange tanks; but, in emergency situations as with a fire fighter, the time to fill a tank or to exchange tanks is time the fire fighter may need to save someone from a fire, or to assist in extinguishing a fire.

While it may appear at first blush to be an obvious thing to provide a separate fill valve for an air tank on an SCBA, it must be realized that safety considerations prevent the use of an extension hose that could be damaged and quickly empty the air tank. The existing hoses of an SCBA include means for preventing rapid discharge of air, the mouthpiece being connected through a dual pressure regulator, and the gauge being connected through a small orifice for severely restricting air flow. Thus, neither of these standard items is readily adaptable to tank filling.

SUMMARY OF THE INVENTION

The present invention provides an air tank filling means for a self contained breathing apparatus wherein a quick disconnect valve is mounted on the body attached to a hose extending to the front of the user, the quick disconnect providing for connection of a source of air under pressure for filling the air tank. The required small orifice in the hose is placed in parallel with a check valve oriented so that air must bleed through the small orifice to flow from the air tank to the body, but the check valve shifts to allow substantial air flow in the direction from the body to the air tank. The safety of the small orifice is therefore provided as required, while a convenient tank filling means is provided. Further, since the conventional SCBA already includes a gauge, the quick disconnect valve may be on the gauge body, so the user is not required to add yet another piece of equipment to the SCBA.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
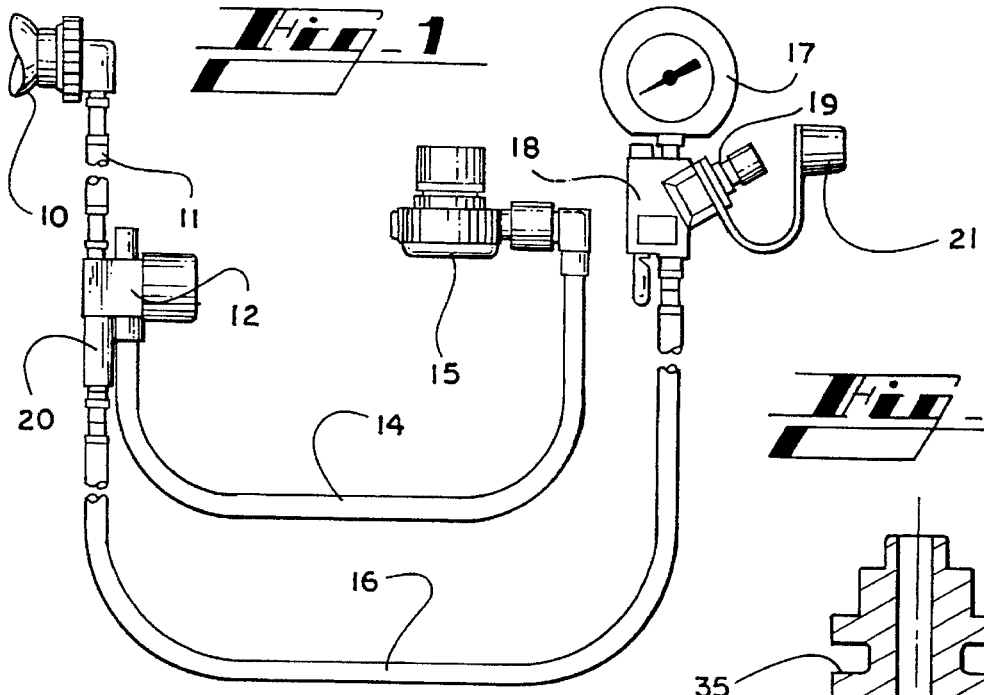
FIG. 1 is a front elevational view showing a self contained breathing apparatus having a tank filling system made in accordance with the present invention.

Referring now more particularly to the drawings, and to that embodiment of the invention here presented by way of illustration, FIG. 1 of the drawings shows a generally conventional self contained breathing apparatus (SCBA), but with the filling system of the present invention incorporated. An air tank is shown fragmentarily at 10, and a hose 11 communicates with a pressure regulator 12. From the pressure regulator 12, a hose 14 is connected to the mouthpiece 15. Also connected to the pressure regulator 12, there is a hose 16 connected to the gauge body 18. The gauge 17 is connected to the gauge body 18 to indicate the pressure in the tank 10.

The above discussed apparatus is well known in the art. The present invention, however, includes a fill valve 19 in the gauge body 18, and a flow restraining check valve 20 in the gauge hose 16. The fill valve 19 includes a cover 21 for protection of the valve 19 when not in use. It will be understood by those skilled in the art that the gauge hose may be any hose that extends around to the front of the user. The gauge hose and gauge body are here used by way of illustration, but the invention is equally applicable to other equipment similarly situated.

Figure 2:
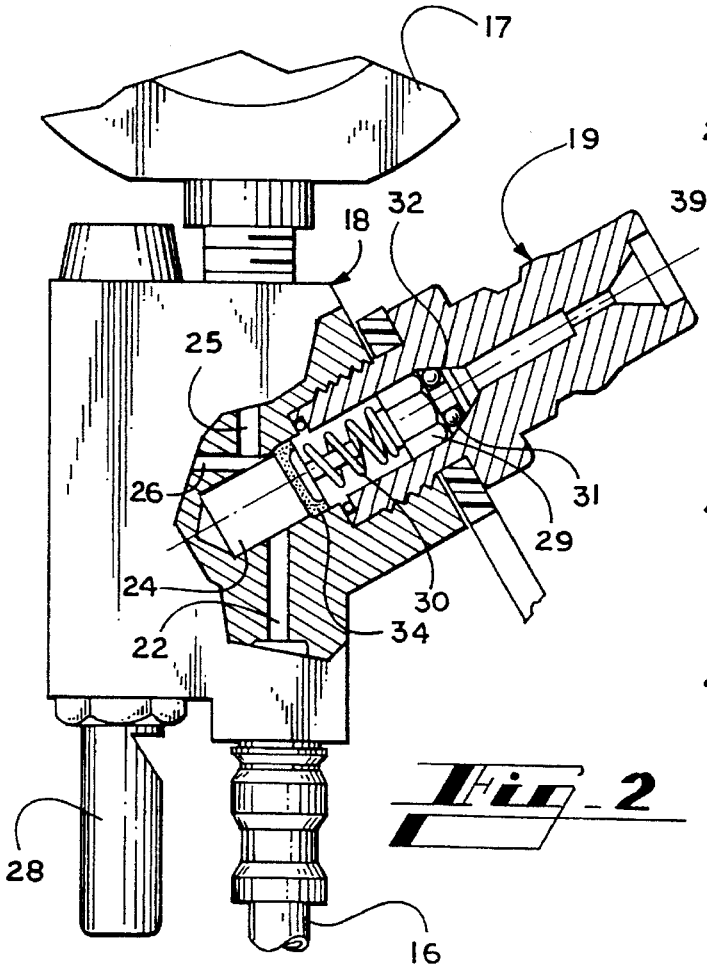
FIG. 2 is an enlarged, fragmentary view showing the fill valve of the present invention; and, FIG. 3 is an enlarged diametrical cross-sectional view showing the flow restricting check valve of the present invention.

Looking at FIG. 2 of the drawings, the gauge body 18 is shown in more detail. As is conventional, the hose 16 connects to the body 18, the hose 16 being in communication with a passage 22. The passage 22 is then connected through a drilled hole 24 to a passage 25 leading to the gauge 17. A branch 26 leads to the low-pressure whistle 28 as is well known in the art.

The only novel portion of the gauge body 18 is the addition of the quick disconnect valve 19 for use as a fill valve. It will be seen that the valve 19 includes a check valve having a valve member 29 that is spring urged to a closed position by the spring 30. The valve member 29 includes an O-ring 31 for effecting a seal with the valve seat 32. It will therefore be seen that the spring 30 normally urges the valve member 29 towards the valve seat 32, so pressure from the passage 22 cannot escape through the valve 19. When the valve 19 is connected to a source of high pressure air, however, the valve member 29 will be moved down, against the tension of the spring 30, removing the O-ring 31 from the valve seat 32 and allowing air to flow through the valve, and into the passage 22 and the hose 16.

Preferably, a filter 34 is disposed between the incoming air and passage 22. The filter may be a sintered body, or may comprise other forms of filters.

Figure 3:
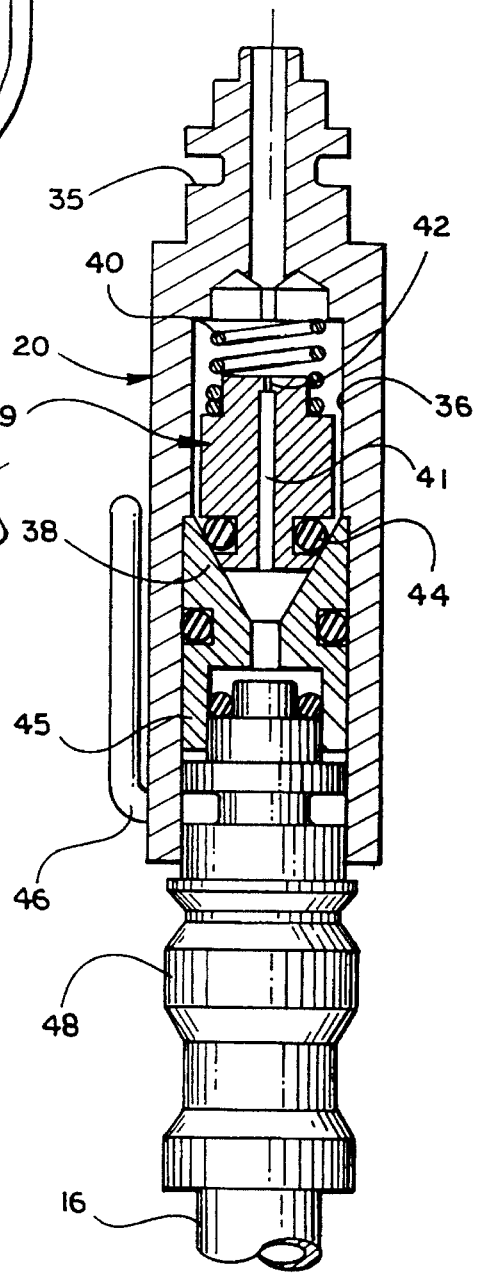

The flow restricting check valve 20 is shown in detail in FIG. 3 of the drawings. It will be understood that the check valve 20 is provided with a male plug member 35 to be received in the body of the pressure regulator 12. The plug 35 is of a type well known in the art and requires no further discussion.

The check valve 20 defines a central bore 36 having a valve seat 38 fixed therein, and a valve member 39 urged against the valve seat by a spring 40. It will be seen that the valve member 39 includes a passageway 41 axially thereof, the passageway 41 terminating in a small orifice 42. The valve member 39 also includes, at the opposite end thereof, an O-ring 44 for sealing the valve member 39 with respect to the valve seat 38.

Those skilled in the art will understand that there must be some possible air flow through the hose 16 in order to register the air pressure on the gauge 17; however, there is a safety requirement that flow through the hose 16 be not more than 70 liters per minute. Thus, when air flows through the check valve 20 to register air pressure on the gauge 17, the valve member 39 will be seated on the valve seat 38, so the only air flow must be through the small orifice 42. However, when a source of high pressure air is connected to the valve 19 to fill the tank 10, the high pressure will urge the valve member 39 away from the seat 38, against the tension of the spring 40. Air can then flow around the valve member 39 so that a substantial flow is possible.

It will be recognized that the effect of the above described construction is to have the required flow restricting orifice in parallel with a check valve. While the preferred embodiment here shown has the orifice defined in the valve member, one might equally well have a separate valve member and orifice parallel to each other to achieve the same function.

As here shown, the check valve 20 also includes a female plug 45 so the hose 16 can be separated therefrom easily. Again, the quick disconnect plug is of a type well known in the art; however, to allow use of only equipment embodying the present inventive system, a pin 46 extends across the female plug 45. The male plug 48 must therefore be properly keyed to clear the pin 46 and be engaged with the plug 45. It will be understood that a unique form of connector or other means may be used if desired to assure a proper match in the equipment.

From the foregoing, it will be understood that the present invention provides a very simple, and easy to use, system for filling the air tank of an SCBA while a user is wearing the SCBA. The filling valve 19 is part of the existing gauge body 18, so the user does not have to contend with additional hoses or the like in the system. The filling valve 19 includes a check valve to prevent air loss. The flow restricting check valve 20 allows normal use of the gauge 17, with the required restriction on air loss in the event the hose 16 is ruptured, but the valve can be shifted to allow substantial flow in the opposite direction for filling the tank 10.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A self contained breathing apparatus comprising an air tank, a pressure regulator mounted adjacent to said air tank and in communication therewith, said pressure regulator receiving fluid at high pressure from said air tank and reducing said fluid to a lower pressure, a first hose connected to said pressure regulator, and a mouthpiece fixed to said first hose so that said mouthpiece receives fluid from said pressure regulator through said first hose, a valve body connected to said pressure regulator for receiving fluid from said pressure regulator, a second hose connected to said valve body, a gauge body connected to said second hose and a pressure gauge fixed to said gauge body, said valve body defining a flow restricting orifice for allowing limited fluid flow through said second hose for registering fluid pressure on said pressure gauge, an air tank fill valve on said gauge body, said fill valve selectively providing communication with said second hose, and a check valve in said valve body connected in parallel with said flow restriction orifice for allowing fluid flow from said second hose towards said air tank sufficient for filling said air tank.

2. Apparatus as claimed in claim 1, wherein said check valve includes a valve member for selectively allowing and preventing fluid flow, said flow restriction orifice being defined in said valve member so that limited fluid flow is allowed when said check valve is closed.

* * * * *